United States Patent [19]

Bosshard et al.

[11] Patent Number: 4,615,115

[45] Date of Patent: Oct. 7, 1986

[54] METHOD FOR CONNECTING A PLUG CONNECTOR TO A CABLE

[75] Inventors: Andreas Bosshard; Bernhard Lämmler, both of Herisau, Switzerland

[73] Assignee: Huber & Suhner AG, Herisau, Switzerland

[21] Appl. No.: 767,338

[22] Filed: Aug. 21, 1985

Related U.S. Application Data

[62] Division of Ser. No. 554,764, Nov. 23, 1983, Pat. No. 4,545,637.

[30] Foreign Application Priority Data

Nov. 24, 1982 [CH] Switzerland ..... 6857/82

[51] Int. Cl.[4] ..... H01R 43/02

[52] U.S. Cl. ..... 29/860; 29/828

[58] Field of Search ..... 79/828, 882, 857, 860; 174/75 C, 88 C; 339/177 R, 59 R, 60 R

[56] References Cited

U.S. PATENT DOCUMENTS

| | | | |
|---|---|---|---|
| 2,161,606 | 6/1939 | Andre | 339/59 R |
| 2,379,942 | 7/1945 | Webber | 339/60 R |
| 3,192,308 | 6/1965 | Van Horssen et al. | 339/177 R X |
| 3,406,373 | 10/1968 | Forney, Jr. | 174/75 C X |
| 3,982,060 | 9/1976 | Avery et al. | 339/177 R X |
| 4,059,330 | 11/1977 | Shirey | 339/177 R |
| 4,305,638 | 12/1981 | Hutter | 339/177 R |
| 4,345,370 | 8/1982 | Cartier et al. | 174/75 C X |
| 4,456,323 | 6/1984 | Pitcher et al. | 339/177 R |

*Primary Examiner*—Mark Rosenbaum
*Assistant Examiner*—Carl J. Arbes
*Attorney, Agent, or Firm*—Bernard, Rothwell & Brown

[57] ABSTRACT

A flexible coaxial cable has a special plug connector with a tensile strength comparable to that of the cable at the connecting point to the cable. This plug connector (14) consists of a nipple (1) which is threaded with a plug sleeve (3). Between these two plug elements is arranged a contact ring (2) which is soldered to the covering (23). This contact ring (2) includes a bore (13), through which the soldering can be optically controlled and the vapors can be vented during soldering. The end surfaces of the contact ring (2) and the cable dielectric (21) are face-turned. Accordingly, the cable lengths can also be precisely determined. The exposed inner conductor (20) is soldered to a plug pin (4). The plug dielectric (5), plug pin (4) and the plug housing (3) itself are held in rigid positions in the plug housing (3) by means of a bore (10) filled with epoxy resin (9) and by a constriction (11) in the plug pin (4). This plug connector (14) also permits a precise control of impedance adaptation during and after soldering.

4 Claims, 10 Drawing Figures

METHOD FOR CONNECTING A PLUG CONNECTOR TO A CABLE

This is a division of application Ser. No. 554,764, filed Nov. 23, 1983, now U.S. Pat. No. 4,545,637 issued Oct. 8, 1985.

BACKGROUND OF THE INVENTION

1. Field of the Invention

The present invention relates to an improved plug connector for flexible coaxial cables and to a method for connecting same.

2. Prior Art

In the magazine *Mikrowellen Magazin* Nr. 3, 1977, the company Gore & Co. GmbH, D8011 Putzbrunn bei Muenchen, compares a flexible coaxial cable with a semirigid cable. The design of such a flexible coaxial cable includes an inner conductor made of 19-stranded silvered copper. The stranding results in the required flexibility and prevents the inner conductor from wandering within the dielectric layer during bending. A polyetetrafluorethylene is suggested as the dielectric, which substance has been stretched and therefore, as a matrix-like structure, it has a high proportional component of air. To achieve the necessary concentric structure, the dielectric material is coiled here about the inner conductor.

As is known, the covering reduces emissions or radiation to a minimum. With flexible coaxial cables the electrical values must be assured, even during bending. In the described coaxial cable this is achieved in that a silvered copper foil was overlappingly coiled onto the dielectric layer and this first covering is surrounded with a second covering of woven silvered copper wire. Finally, the thus-constructed cable is provided with a plastic exterior cover.

In a second publication in the same magazione, *Mikrowellen Magazin* Nr. 4, 1980, it is mentioned that a new cable construction will require new plug connectors. Such a new plug is not described in either of the publications with any specificity beyond simple suggestions.

There is a need in the art for a plug connector which fulfills the peculiar requirements of flexible microwave coaxial cables.

SUMMARY OF THE INVENTION

According to the invention this is achieved by a plug connector and a method for connecting the plug connector.

DETAILED DESCRIPTION OF THE PREFERRED EMBODIMENT

Figure 1:
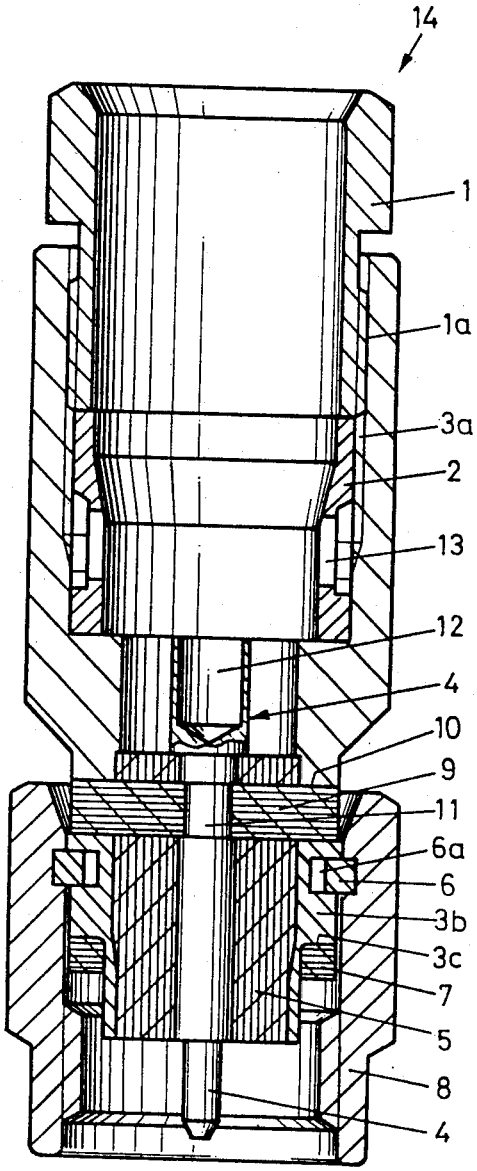
FIG. 1 is a sectional view of a plug connector according to the,invention.
Figure 2:
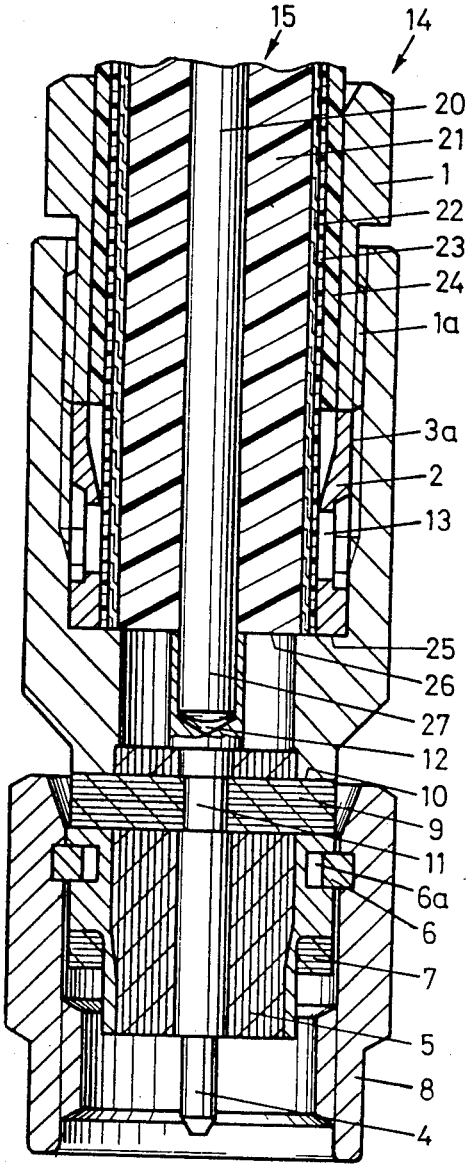
FIG. 2 is the same sectional view as FIG. 1, but also shows the coaxial cable in section.

The coaxial cable 15 according to FIG. 2 consists, as viewed from the inside out, of an inner conductor 20, a layer 21 of a dielectric material concentrically surrounding this inner conductor, such a polytetrafluorethylene, a first covering 22 of silvered copper strip overlappingly coiled onto the layer 21, a second covering 23 of woven copper wire and an exterior cover 24, for example, of polytetrafluorethylene.

The coaxial plug connector 14 consists of the following details: a nipple 1 with an exterior threading 1(*a*) lying closely against the exterior cover 24, a contact ring 2 having a radial bore 13 which can be made as a penetrating bore, a plug housing 3 with an interior threading 3*a* complementary to the exterior threading 1*a* and with a sleeve 3*b* on the end lying opposite the interior threading 3*a*, a plug dielectric 5 located in a sleeve 3*b*, and a connecting sleeve 8. A plug pin 4 having a constricted section 11 includes an axial hollow chamber 12 at the inner end of the plug for the inner conductor 20 of the coaxial cable 15. The sleeve 3*b* and the plug dielectric 5 are also diametrically bored through. This bore 10, when constructed, is aligned with the constricted section 11 of the plug pin 4. This bore 10 is filled with cast epoxy resin, so that a radial centering support 9 is formed.

A circlip or snap ring 6 is inserted in an annular groove 6*a* in the outer wall of the sleeve 3*b*, which circlip 6 enqages in an annular groove 8*a* in the inner wall of the connecting sleeve 8 and thereby holds the connecting sleeve 8 in a condition in which it can rotate freely with at most a limited amount of axial play. Finally, an additional seal 7 of an elastic material, such as rubber, is placed on a shoulder 3*c* on the outside of the sleeve 3*b*.

In the constructed condition according to FIG. 2 the inner conductor 20 of the coaxial cable 15 is soldered in the hollow chamber 12 of the plug pin 4. The contact ring 2 lies on the second covering 23 and is also soldered thereto. The bores 13 serve on the one hand to provide optical control for proper soldering, i.e., whether the soldering material has flowed correctly, and on the other hand steam and the gas of the flux material can escape through these bores 13, so that the soldering material also has enough space to spread out.

Figure 3:
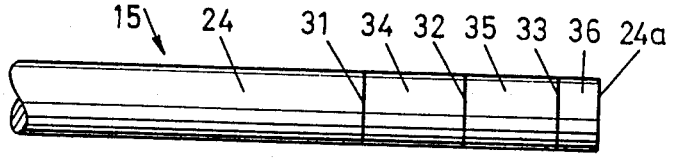
FIGS. 3–10 are views of a coaxial cable in different mounting stages of the plug connector according to FIGS. 1 and 2.
Figure 4:
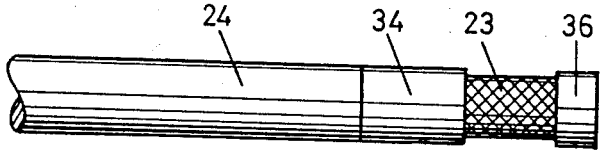
Figure 5:
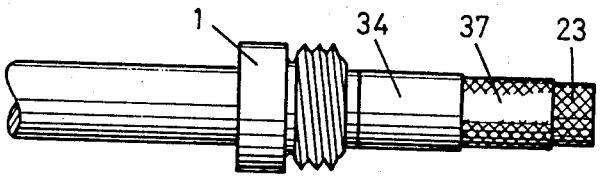
Figure 6:
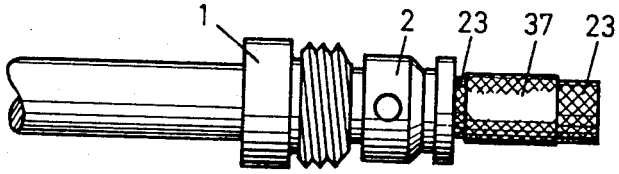
Figure 7:
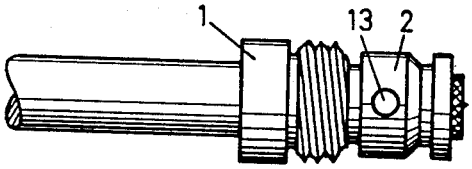
Figure 8:
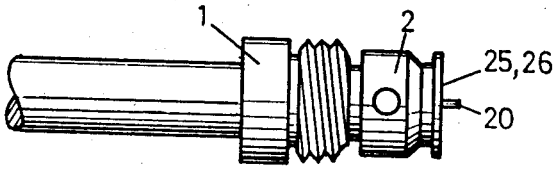
Figure 9:
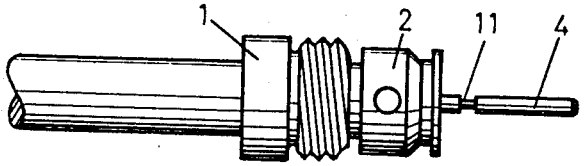

To connect the plug connector 14 to a coaxial cable 15, the coaxial cable 15 is first cut to the precise length. The cut surface 24(*a*) must be smooth. Then the outer cover 24 is cut all the way around at three locations 31, 32, and 33. There are thus produced an end cover section 36, a center cover section 35 and an inner cover section 34 (FIG. 3). The center cover section 35 is then removed (FIG. 4) and the exposed weaving of the second covering 23 is tinned. A soft solder, which melts at 180° C. is used for this purpose, so that a tinned section 37 is produced. The end cover section 36 is then removed, a shrink tube (not shown) is pushed over the thus-prepared cable 15. From the plug connector 14 the nipple 1 is then pushed onto the exterior cover 24 (FIG. 5). The contact ring 2 is then pushed onto the tinned section 37, before the inner cover section 34 is then removed and the contact ring 2 can be pushed down to the exterior cover 24. In this manner the construction according to FIG. 6 is attained. In this phase of construction the contact ring 2 is soldered to the covering 23. Here, too, a solder is used having a melting point of 180° C. The cable 15 is then cut about 1.8 mm above the contact ring 2 (FIG. 7), and the cut surface is then face-turned, and simultaneously the contact ring 2 is shortened by 0.1–0.2 mm. By this procedure the inner conductor 20 is exposed (FIG. 8) and the cable lenqth can also be determined in this manner. In the known plug connectors this was not possible in such a simple manner. According to FIG. 9 the plug pin 4 is then soldered to the inner conductor 20. This can take place advantageously by means of resistance soldering.

Figure 10:
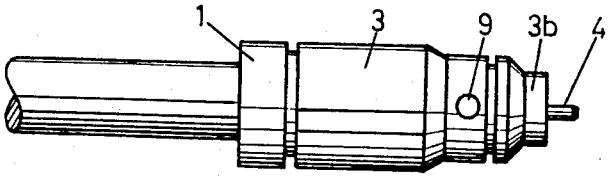

The cable is then introduced into the plug housing 3, which is then threaded onto the nipple 1 (FIG. 10). In this condition the cable and its connecting points with the plug connector can then be examined. If a shrink tube was pushed onto the cable in the phase according to FIG. 5, it can now be correctly positioned before it is shrunk with hot air at about 150° C.

Finally, the bore 10 must be filled with epoxy resin and the resin must be permitted to cure before the circlip 6 can be put in place and the seal 7 and connecting sleeve 8 can finally be installed.

The plug connector described here can also be used for a bent connection, such as that described in DE-A No. 29 90 577. The cable cover of the finished cable manufactured by the method steps according to FIGS. 3 through 10 is cut at two spaced points. The space between the cuts should at least approximately encompass the bend. Then the cable is bent with the smallest possible bending radius, the cable cover is removed and at least the outer covering is tinned. This tinning is also advantageously performed with soldering tin that melts at 180° C. The thus-produced curve can finally be covered by means of a shrink tube section. Accordingly, in a simple and inexpensive manner, an angle connection can be formed in which the cable lengths can be compensated and in which the electrical relationships remain uniform and controllable up to the plug transition in the connector element.

We claim:

1. A method for making of a plug connector for a coaxial cable having an inner conductor (20), a dielectric layer (21), a first covering (22) made of an overlapping coiled metal foil band, a second covering (23) made of woven wire, an exterior cover (24), a nipple (1) surrounding the exterior cover, a clamping contact ring (2) surrounding the second covering, a plug pin (4) connected to the inner conductor (20), a plug housing (3) electrically connected with at least one of the two coverings (22, 23), the plug housing having a bore (10), and a connecting sleeve (8) mounted on the plug housing (3), characterized by the cutting of the exterior cover (24) at three locations (31, 32, 33) in the connection area of the cable (15) and removing the center cover section (35) for the purpose of exposing the second covering (23) and tinning this exposed portion of the second covering (23), by removing the end-most cover section (36) and sliding on first the nipple (1) until it is over the exterior cover (24) and then sliding on the contact ring (2), by removing the remaining cover section (34) and pressing the contact ring (2) against the exterior cover (24) and soldering the contact ring (2) to the coverings (22, 23), then cutting the cable (15) shortly in front of the contact ring (2) and face-turning the cut surface down to the inner conductor (20) with a simultaneous shortening of the contact ring (2), then characterized by attaching the plug pin (4) to the inner conductor (20) and soldering same, and further by attaching the plug housing (3) to the cable (15) and threading same with the nipple (1) and then casting the bore (10) in the plug housing (3) with epoxy resin and finally by mounting the connecting sleeve (8) with a circlip (6) and a sealing ring (7).

2. Method according to patent claim 1, characterized in that the cable (15) is cut at a distance of about 1.8 mm in front of the contact ring (2), and in that during the face-turning the contact ring (2) is shortened by 0.1–0.2 mm.

3. Method according to patent claim 2, characterized in that the soldering of the contact ring (2) with the coverings (22, 23) is done with soft solder having a melting temperature of 180° C.

4. Method according to patent claim 3, characterized in that the soldering of the plug pin (4) to the inner conductor (20) takes place by resistance soldering.

* * * * *